US006330775B1

(12) United States Patent
Hubbard

(10) Patent No.: US 6,330,775 B1
(45) Date of Patent: Dec. 18, 2001

(54) PREFABRICATED BUILDING WALL STRUCTURE

(76) Inventor: Richard L. Hubbard, 11191 Riverdall Ct., Pinckney, MI (US) 48169

( * ) Notice: Subject to any disclaimer, the term of this patent is extended or adjusted under 35 U.S.C. 154(b) by 0 days.

(21) Appl. No.: 09/357,505

(22) Filed: Jul. 20, 1999

(51) Int. Cl.[7] ..... E04B 9/00; E04C 2/34

(52) U.S. Cl. ..... 52/474; 52/481.1; 52/238.1; 52/479; 52/36.1; 52/481.2

(58) Field of Search ..... 52/474, 481.1, 52/481.2, 483.1, 479, 242, 270, 271, 407.1, 407.3, 238.1

(56) References Cited

U.S. PATENT DOCUMENTS

| | | | | |
|---|---|---|---|---|
| 2,245,611 | * | 6/1941 | Schultz | 189/34 |
| 2,928,462 | * | 3/1960 | Neisewander | 160/229 |
| 2,994,413 | * | 8/1961 | Levy et al. | 189/34 |
| 3,305,993 | * | 2/1967 | Nelsson | 52/481.1 |
| 3,429,090 | * | 2/1969 | Metelnick | 52/481.1 |
| 3,694,975 | * | 10/1972 | Pollock | 52/36 |
| 3,712,015 | * | 1/1973 | Nelsson | 52/481.1 |
| 3,852,927 | * | 12/1974 | Birum, Jr. | 52/241 |
| 3,861,101 | * | 1/1975 | Whisson | 52/238 |
| 3,872,639 | * | 3/1975 | Crumbaugh et al. | 52/495 |
| 3,882,652 | * | 5/1975 | Marchello | 52/481.1 |
| 3,958,372 | * | 5/1976 | Benbow | 52/36 |
| 3,986,312 | * | 10/1976 | Calhoun et al. | 52/242 |
| 4,016,690 | * | 4/1977 | Richardson | 52/238 |
| 4,107,887 | * | 8/1978 | Wendt | 52/105 |
| 4,161,087 | * | 7/1979 | Levesque | 52/62 |
| 4,234,634 | | 11/1980 | Longinotti . | |
| 4,255,910 | * | 3/1981 | Wendt | 52/481.1 |
| 4,370,838 | * | 2/1983 | Vermillion | 52/36 |
| 4,375,741 | * | 3/1983 | Paliwoda | 52/127.1 |
| 4,590,733 | * | 5/1986 | Schmeller et al. | 52/741 |
| 5,038,541 | | 8/1991 | Gibbar, Jr. . | |
| 5,086,602 | * | 2/1992 | Pukas | 52/713 |
| 5,228,249 | | 7/1993 | Campbell . | |
| 5,287,675 | * | 2/1994 | McGee | 52/770 |
| 5,325,641 | * | 7/1994 | Felton | 52/36.4 |
| 5,465,545 | | 11/1995 | Trousilek . | |
| 5,632,127 | * | 5/1997 | Agar et al. | 52/481.2 |
| 5,634,315 | | 6/1997 | Toya . | |
| 5,743,056 | | 4/1998 | Balla-Goddard et al. . | |
| 5,765,330 | | 6/1998 | Richard . | |
| 5,809,729 | * | 9/1998 | Mitchell | 52/474 |
| 5,884,447 | * | 3/1999 | Earp | 52/489.1 |
| 5,916,100 | * | 6/1999 | Mitchell et al. | 52/235 |
| 6,047,508 | * | 4/2000 | Goodman et al. | 52/241 |
| 6,076,322 | * | 6/2000 | D'Andrea et al. | 52/481.1 |
| 6,094,875 | * | 8/2000 | Laine | 52/220.7 |

* cited by examiner

*Primary Examiner*—Alvin Chin-Shue
*Assistant Examiner*—Khoa Tran
(74) *Attorney, Agent, or Firm*—Gifford, Krass, Groh, Sprinkle, Anderson & Citkowski, P.C.

(57) ABSTRACT

A prefabricated structure for use in constructing a building wall including a first elongated joist extending horizontally and secured a ceiling of the structure and a second elongated joist secured to a floor of the structure and extending in horizontally and in parallel spaced apart fashion from the first joist. Each of the first and second joists including a parallel extending and opposing face with a recessed channel formed therein. A plurality of elongate and planar boards, each substantially rectangular in shape, include first, second, third and fourth edges. The edges define in combination a first face and a second opposite face spaced from the first face by a determined thickness. A first selected edge of each planar board securing in extending fashion within the recessed channel of the first joist and a further selected and parallel extending edge securing within the recessed channel of the second joist. A plurality of elongate brackets are provided for securing each of the elongate and planar boards in end-to-end abutting and reinforcing fashion with succeeding elongate and planar boards and for securing a wall board material in a parallel extending and spaced relationship with respect to at least one of said first and second faces of said elongate and planar boards.

17 Claims, 5 Drawing Sheets

PREFABRICATED BUILDING WALL STRUCTURE

BACKGROUND OF THE INVENTION

1. Field of the Invention

The present invention relates generally to building wall structures and, more particularly, to a prefabricated wall structure which provides for the attachment of insulation and wall board and which is a replacement for standard stud wall constructions in that it provides for quicker assembly of a building structure.

2. Description of the Prior Art

The use of prefabricated materials in the construction of buildings has become fairly well known in the art. Traditionally, wooden frame construction homes have utilized standard wooden studs and trusses which are assembled by hand on location. The drawbacks of such construction are primarily the time and effort requirements of the construction workers in erecting the wall sections.

Referring to the All Joist Alliance Product Manual Brochure, a series of prefabricated joist assemblies are employed in the construction of floor and roof systems for buildings. The joists include top and bottom joist members and a compressed wood board extending therebetween. However, and as made clear by the All Joist Brochure, the assemblies described do not appear to have application in use as floor to ceiling wall assemblies which replace the need for standard building construction.

Additional examples of prefabricated wall panels assemblies are illustrated in U.S. Pat. No. 5,765,330, issued to Richard; U.S. Pat. No. 5,465,545, issued to Trouisilek; and U.S. Pat. No. 4,234,634, issued to Longinotti. In the instance of Richard, the pre-insulated wall panel illustrated includes a rectangular wall frame with top and bottom rail members and a plurality of spaced apart stud members aligned between the rail members. A polystyrene boardstock is affixed to a first side of the rectangular wall frame and a layer of foamed in place polyurethane covers a portion of each cavity adjoining the boardstock.

In the instance of the Trousilek disclosure, a multi-component modular system is disclosed which includes elongate and generally rectangular plastic prefab forms which interlock together so as to define a plurality of vertically extending and concrete-filling passageways. Finally, Longinotti discloses a prefabricated construction for building walls and which includes a pair of panel elements each having a wall portion and a plurality of stiffening rib portions extending along the wall portion. Specified rib portions include recesses which are spaced from the wall portions, and within which are filled an expanded synthetic material to form a wall element. Conduit passageways are defined in the synthetic material between the pair of panel elements and adjacent the recesses in the rib portions.

SUMMARY OF THE PRESENT INVENTION

The present invention is a prefabricated structure for use in constructing a building wall and which offers significant improvements in the time and effort which are required for constructing a floor to ceiling wall structure. The structure includes a first elongate joist extending horizontally and secured to a ceiling of the structure. A second elongate joist is secured to the floor and extends in a likewise horizontally and parallel spaced apart fashion relative to the first joist. Each of the first and second joists includes a rectangular cross section with opposing and parallel extending faces with a recessed channel being formed within each of the opposing and parallel faces.

A series of elongate and planar boards, substantially rectangular in shape and preferably constructed of ½" thick OSB board, are provided and define first and second opposing faces which are separated by a determined thickness. Selected opposite and parallel extending edges of each of the planar boards are secured within the recessed channels in end-to-end abutting fashion. A plurality of elongate brackets are provided and are capable of being secured together against the opposing faces of the adjoining planar boards and so as to both secure the boards in their end-to-end abutting fashion, as well as to provide a convenient mounting means for securing a wall board or drywall material.

According to further preferred embodiments, the elongate brackets may define a substantially "U" shape in cross section with first and second spaced apart planar sides and an interconnecting portion located at a base of the sides. Alternatively, the first and second planar sides may extend in opposite and parallel spaced directions relative to each other and from the interconnecting portion. When securing two succeeding planar boards in end-to-end fashion, a plurality of four elongate brackets are employed in vertically extending fashion and so as to extend along the first and second opposite faces of the planar members and along opposite vertically extending edges of the planar members. The brackets are secured together in pairs on the opposite sides of the planar boards and, in a further variant, a fifth and somewhat enlarged "U" shaped bracket is provided and which functions as a center cap to secure the first and second pairs of elongate brackets in a more reinforced manner.

Additional to providing end-to-end securement of the planar boards, the elongate brackets may be secured along their first planar sides to the planar boards in either horizontally or vertically extending fashion and so that drywall or other wall board material may be secured against the second parallel and spaced planar sides. According to a yet further variant, an insulating material (such as a styrofoam sheeting) may be applied to at least one of the first and second faces of the elongate and planar board.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
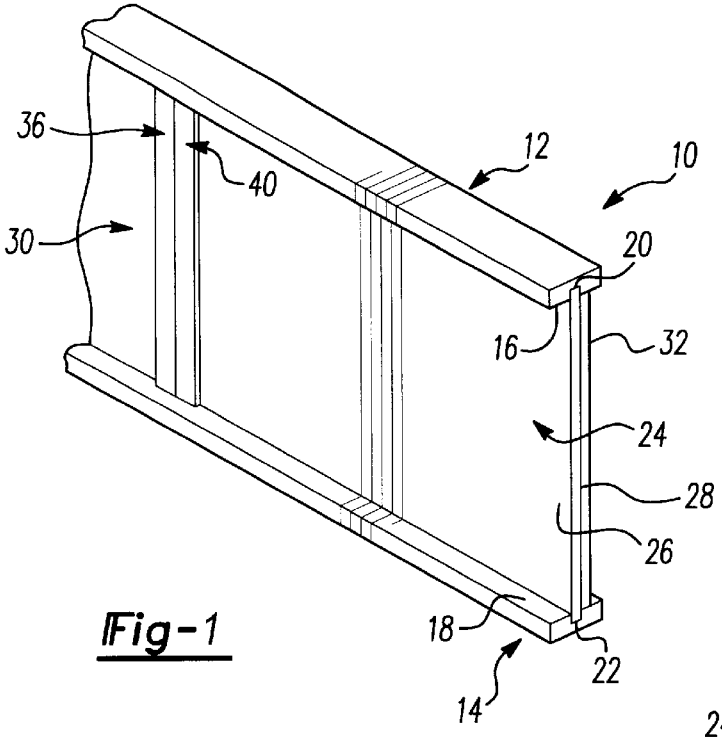
FIG. 1 is a perspective view of the prefabricated wall structure according to a first preferred embodiment of the present invention.
Figure 2:
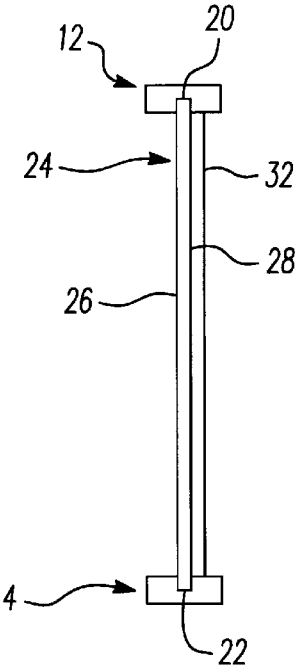
FIG. 2 is an end view of the prefabricated wall structure as shown in FIG. 1.

Referring now to FIG. 1, a prefabricated structure is illustrated at 10 according to a first embodiment for use in constructing a building wall. The prefabricated structure includes a first elongate joist 12 and a second elongate joist 14, both of which are preferably constructed of wood and which include opposing and parallel extending faces 16 and 18, respectively. Formed within each of the parallel extending faces 16 and 18 in likewise parallel extending fashion are recesses 20 and 22. The joists 12 and 14 are also preferably constructed in rectangular cross section, consistent with standard wall stud construction, however other polygonal cross sectional shapes are possible within the scope of this invention. It is also understood that the joists can either be provided as 2"×4", 2"×6" cross sections or any other dimensions as desired.

An elongate and planar board is shown at 24 and is preferably constructed of a ½" OSB or compressed wood chip material. The planar board 24 is preferably rectangular in dimension and includes first, second, third and fourth edges, as clearly evident from FIG. 1, and which in combination define a first face 26 and a second opposite face 28 spaced from the first face 26 by a determined thickness. A second planar board is illustrated in partial section at 30 in FIG. 1 and is secured in end-to-end fashion to the first planar board 24 in a manner described with reference to FIGS. 3 and 4. Also, top and bottom horizontal edges of the planar boards 24 and 30 are secured within the recesses 20 and 22, such as by adhesives, fasteners or the like. Also, an insulating layer of material 32 may be applied to either one or both of the faces of the planar board, in this case second face 28. Preferably, the insulating material is provided as a 1 and ½" thickness sheet of styrofoam, however other types of insulating material can be employed without departing from the scope of the invention.

Figure 3A:
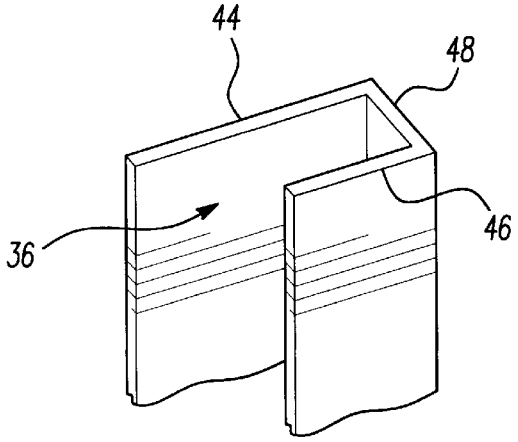
FIG. 3*a* is a partial view of a selected bracket according to a first specified variant as shown in FIG. 3.
Figure 3:
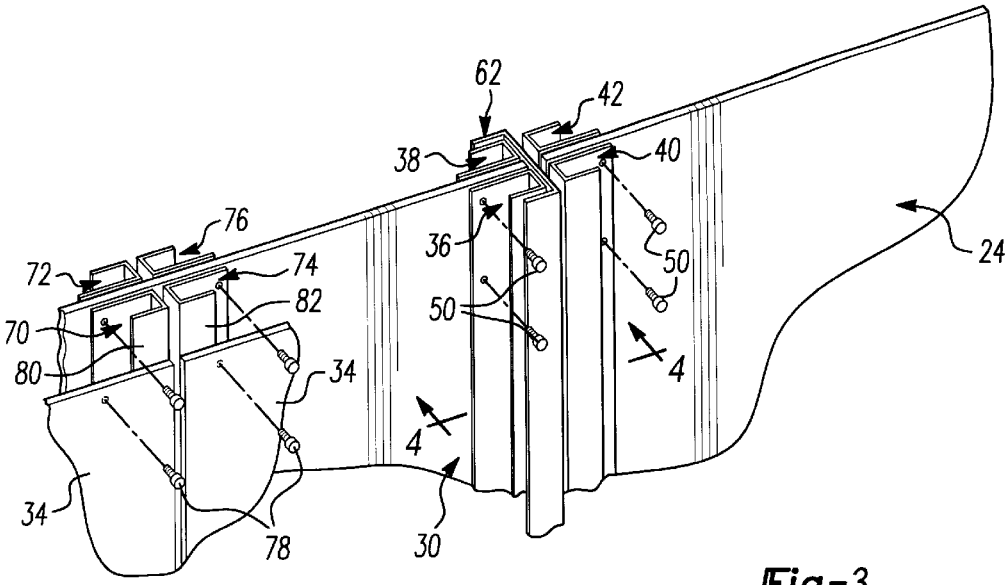
FIG. 3 is a partial view of first and second planar board members being interengaged via elongate brackets and according to a specified variant of the present invention.
Figure 4:
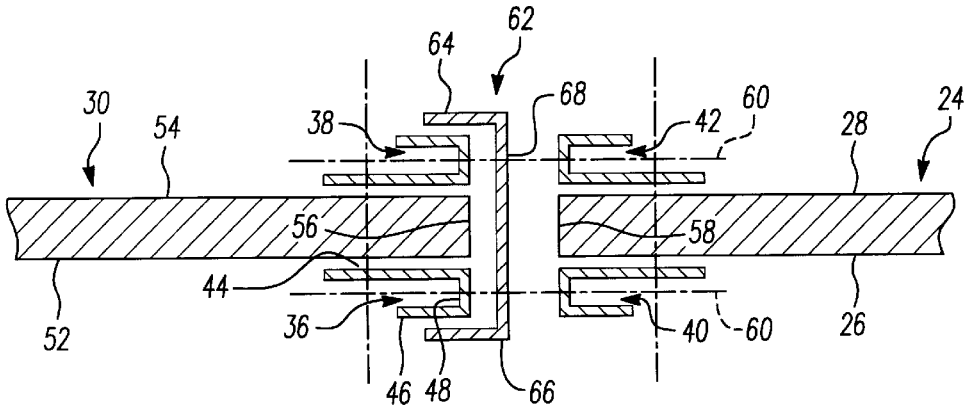
FIG. 4 is a cutaway view taken along line 4—4 of FIG. 3 and further illustrating the mating inter-relationship of the first and second pairs of mounting brackets and the additional reinforcing mounting bracket.

Referring again to FIG. 1, as well as to FIGS. 3 and 4, a plurality of mounting brackets, typically constructed of a metal or metal composite material, are illustrated for use in interconnecting the planar board members 24 and 30 in end-to-end abutting fashion, as well as for assisting in the attachment of a wallboard material 34 (such as drywall) in a spaced relationship with respect to at least one of the first and second faces of the planar boards. As best shown when viewing FIGS. 3 and 4 in combination, one mounting variation of the elongate brackets is shown by first 36, second 38, third 40 and fourth 42 elongated mounting brackets. Referring to FIG. 3*a,* a representative view is shown in partial section of the first elongate bracket 36, it being understood that the second 38, third 40 and fourth 42 brackets are identical in construction. The bracket 36 includes a substantial "U" shape in cross section with a first planar side 44, a second spaced apart and parallel extending planar side 46 and an interconnecting portion 48 extending between the first planar side 44 and second planar side 46. It is also noted that the first planar side 44 is larger somewhat in dimension than the second spaced planar side 46, this being an issue of design choice rather than criticality in construction.

Referring again to FIG. 3, fasteners 50 may be engaged against outwardly facing surfaces of the first planar sides of the brackets to secure the brackets against the planar boards. Specifically, in the illustration consistent with both FIGS. 3 and 4, the first and second brackets 36 and 38 secure in vertically extending fashion and along their respective first planar sides to first 52 and second 54 opposite faces of the elongate and planar board 30. The interconnecting portions of the first and second brackets (again defined by interconnecting portion 48 of first bracket 36) extend perpendicularly outwardly from the opposite faces 52 and 54 of the planar board 30 in level fashion with respect to an associated vertical trailing edge 56 of the planar board 30. Third and fourth elongate brackets 40 and 42 secure in likewise vertically extending fashion and along their respective first planar sides to the first and second opposite faces 26 and 28 of the elongate and planar board 24, the interconnecting portions of the third and fourth brackets extending perpendicularly outwardly from the opposite faces of the planar board level with respect to an associated vertical trailing edge 58 of the planar board 24 and which is arrayed in opposing fashion with the abutting vertical trailing edge 56 of the planar board 30. The outwardly extending and interconnecting portions of the first and second brackets lay substantially flush with the outwardly extending and interconnecting portions of the third and fourth brackets and are respectively secured together, such as by fasteners 60 or adhesives or the like.

A fifth elongate and substantially "U" shaped bracket is illustrated at 62 in cross section includes first and second parallel extending and spaced apart sides 64 and 66 with an interconnecting portion 68 (see FIG. 4). The fifth bracket 62 is of sufficient dimension to be slidingly inserted in vertically extending fashion over the interconnecting portions and second parallel extending sides of the first and second vertically extending brackets 36 and 38 and secures to the first and second brackets, as well as the third 40 and fourth 42 vertically extending brackets through the use of the fasteners or adhesives.

Referring again to FIG. 3, a further application of the elongate brackets is illustrated for permitting the attachment of the drywall or other wallboard type material 34 and includes additional, and identically constructed, brackets 70, 72, 74 and 76 which are secured on the opposite faces of the planar board (in this case the board 30). Fasteners 78 are provided for securing the pieces of wallboard material 34 to the second spaced apart and parallel extending sides of the brackets (in this instance spaced apart and parallel second sides 80 and 82 of first 70 and third 74 brackets).

Figure 5:
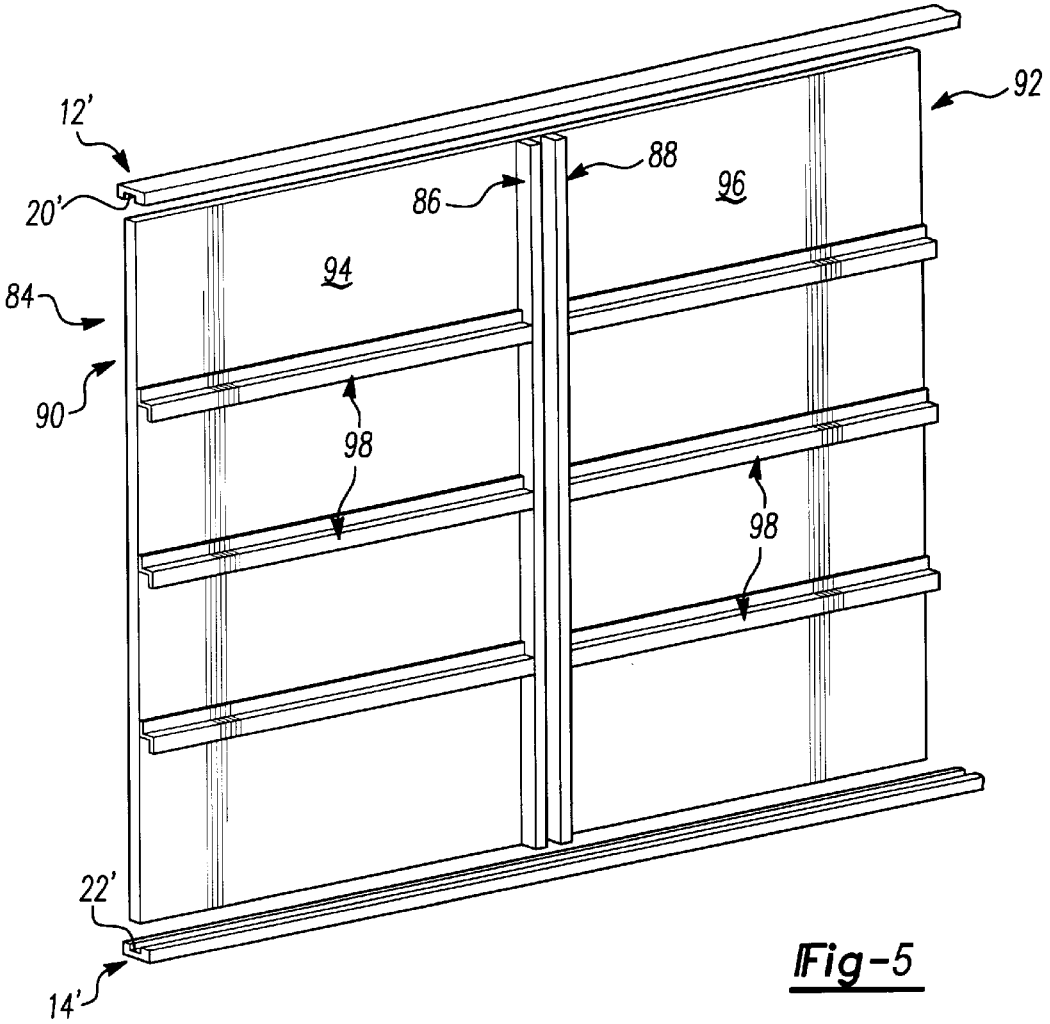
FIG. 5 is a perspective view of the prefabricated wall structure according to a yet further embodiment of the present invention.
Figure 5A:
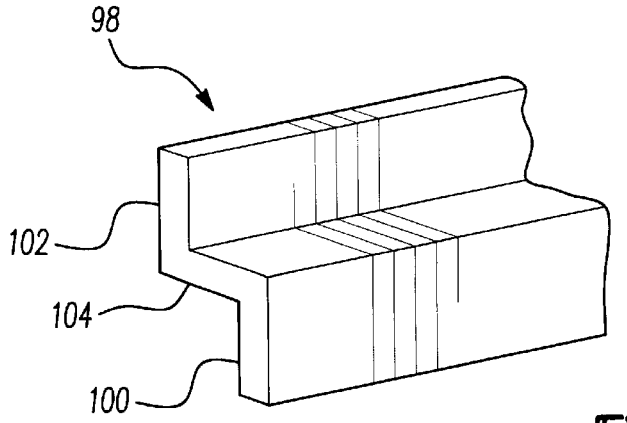
FIG. 5*a* is a partial view of a selected bracket according to a second specified variant as shown in FIG. 5.

Referring now to FIG. 5, a perspective view is illustrated at 84 of a further variation of a prefabricated wall structure and includes a first joist 12' and a second joist 14' with opposingly facing recesses 20' and 22'. Also shown are vertically extending and elongate brackets 86 and 88 for assisting in securing elongate and planar boards 90 and 92 in end-to-end and abutting fashion. A further plurality of brackets 98 extend in spaced apart fashion and horizontally in the instance of FIG. 5 and are secured, along their respective first planar sides, to at least first planar faces 94 and 96 of the planar boards 90 and 92, respectively. An example of the alternate bracket configuration is shown in FIG. 5*a* and includes first planar side 100, second planar side 102 extending in parallel and opposite fashion with respect to first planar side 100, and interconnection portion 104.

Figure 6:
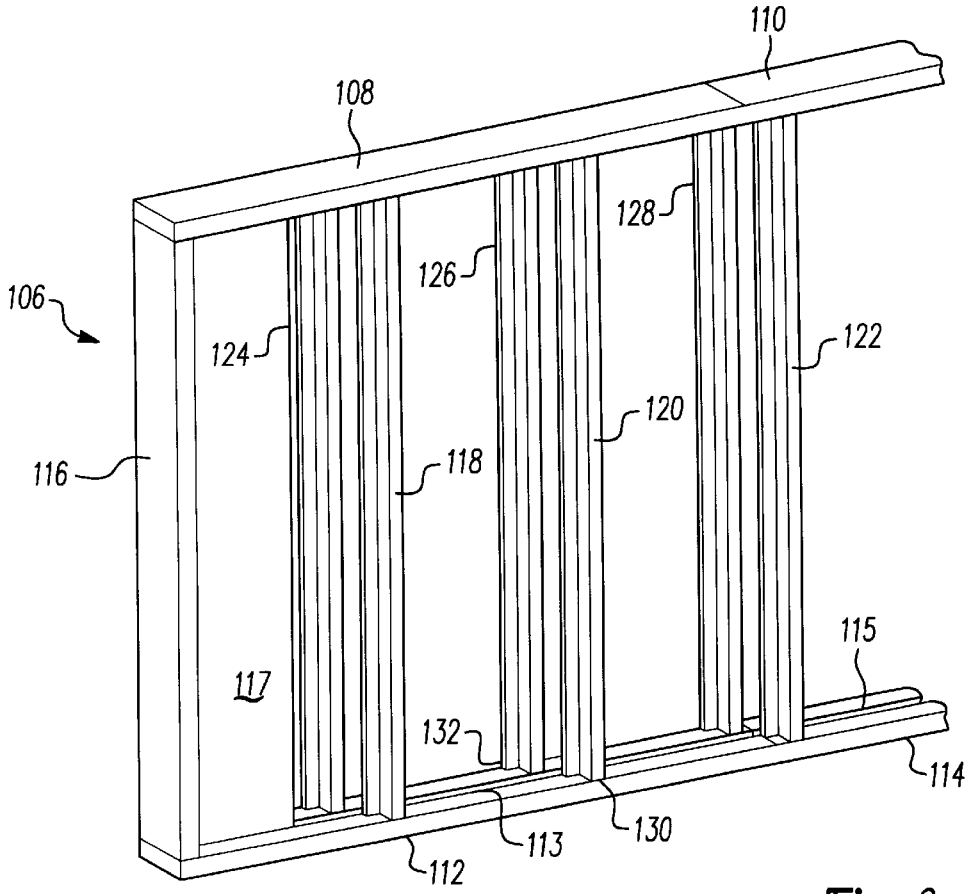
FIG. 6 is a yet further perspective view of the prefabricated wall structure according to a still further embodiment of the present invention.

Referring to FIG. 6, a further perspective view is shown of a prefabricated wall structure which includes subset sections of joists, namely first and second sections 108 and 110 of upperjoists and first and second sections 112 and 114 of lower joists, and which are interconnected at a given end of joist sections 108 and 112 by a vertically extending joist 116. The joist sections are constructed similar to that previously described with recesses formed therein, see at 113 and 115 for joist sections 112 and 114 and which are suitable for seating a planar board, a section of which is illustrated in cutaway at 117.

A plurality of elongate brackets, see at 118, 120 and 122 along a first selected face of the prefabricated structure, and at 124, 126 and 128 along a second selected face. The brackets extend in vertical and spaced apart fashion and are secured, at top and bottom locations of selected planar sides of each bracket, to opposite edges of each of the elongated joist sections. The brackets 118–128 are constructed in the same general configuration as illustrated at 98 in FIGS. 5 and 5*a* and typically secure along their inward planar sides to the opposite faces of the planar board and so that their outward planar sides are arrayed flush with the opposite edges of the joist sections. It is also contemplated that the upper most and bottom most portions of the outward planar sides (see at 130 and 132 by example in FIG. 6) can be secured to the joist sections to facilitate strengthening of the structure.

Figure 7:
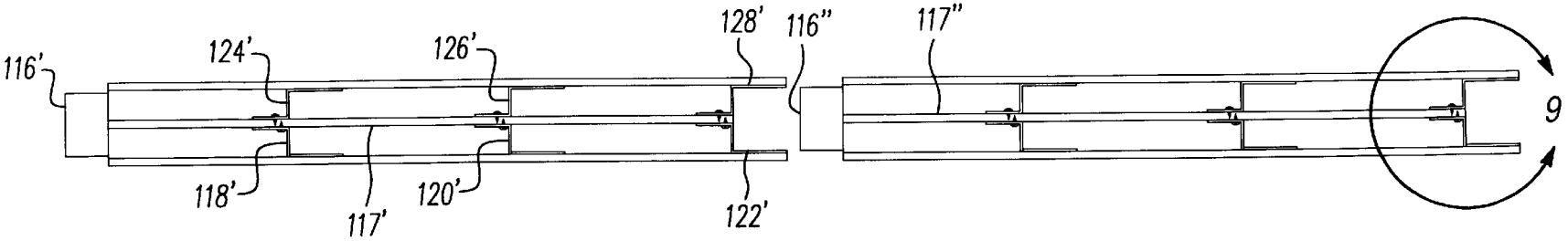
FIG. 7 is a top view of a prefabricated wall structure similar to that illustrated in FIG. 6 and showing alternatively configured elongate brackets interconnecting subset prefabricated wall structures together in end-to-end fashion.

Referring to FIG. 7, a modest variation of the assembly shown in FIG. 6 is illustrated, with the exception of the vertically extending brackets being in alignment with one another. The bottom and top joist sections are removed from the illustration of FIG. 7 and the planar board sections 117' and 117' are illustrated in succeeding arrangement as extending from vertically extending end joist sections 116' and 116". The arrangement of the elongate brackets are, as stated above, in alignment, with brackets 118' and 120' along a first side of the planar board 117' being arranged in alignment with brackets 124' and 126' on an opposite side of the board 117'. The advantage of this construction of the prefab section is that aligning end portions of the brackets (see at 122' and 128' ) define a cavity portion therebetween which is suitable for receiving a succeeding joist 116" for assisting in securing a first prefab wall section to a succeeding wall section.

Figure 8:
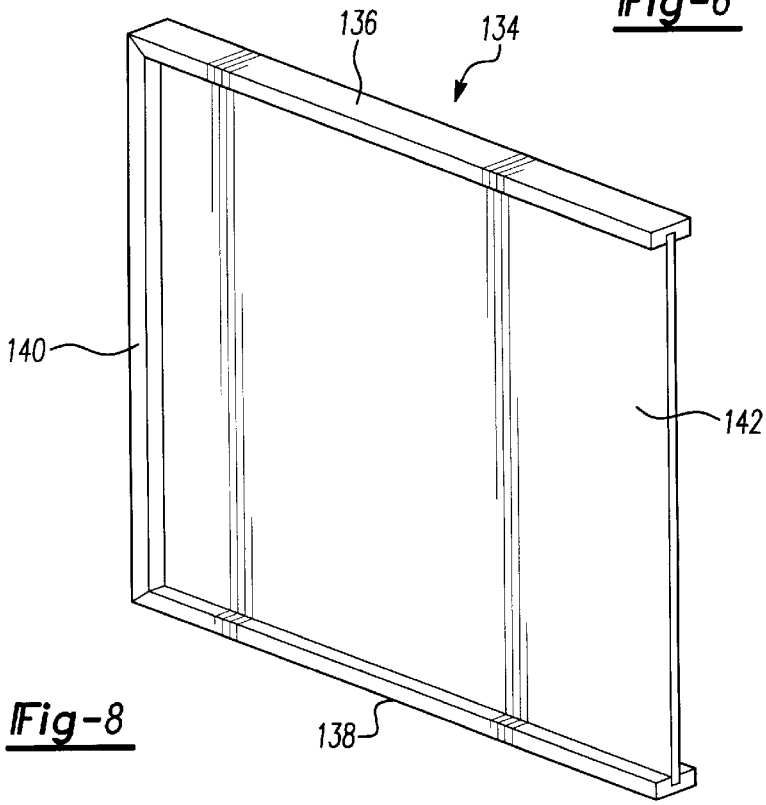
FIG. 8 is a view in perspective of a prefabricated wall structure and illustrating a third and vertically extending elongated joist interconnecting the first and second joists according to the present invention.

Referring to FIG. 8, a simplified view is shown at 134 of a wall section, without any brackets illustrated, and which includes a first horizontally extending joist 136, a second horizontally extending joist 138 and a vertically extending and interconnecting joist 140. Although not shown, it is understood that an identically positioned and second vertical joist may be provided along an opposite end of the horizontally extending joists 136 and 138 and defines in combination a four sided, self contained prefab wall structure for supporting an elongate planar board 142.

Figure 9:
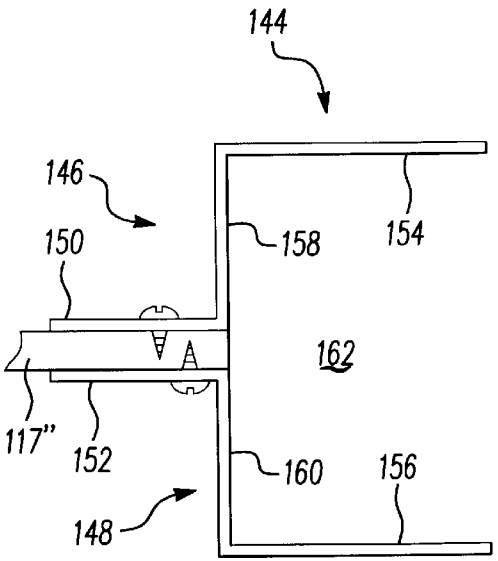
FIG. 9 is an enlarged partial view identified in FIG. 7 and showing in cross sectional cutaway the manner in which a pair of aligned brackets are secured to a trailing vertical edge of a section of planar board according to the present invention.

Referring finally to FIG. 9, an enlarged section of a given pair of end brackets of a succeeding joist section (as previously illustrated in FIG. 7) is shown and includes a first elongate bracket 146 and a second elongate bracket 148 (similar to construction to the brackets shown in FIG. 5*a*). The brackets 146 and 148 are secured along respective first planar sides 150 and 152 to a selected trailing edge of the planar board section 117" and so that the second and opposite extending planar sides 154 and 156 and interconnecting portions 158 and 160. As illustrated by brackets 122' and 128' of FIG. 7, the construction of FIG. 9 provide the means for a vertically extending joist of a succeeding wall section to be seated within the cavity (defined at 162 between the brackets 146 and 148).

Accordingly, it is understood that the present invention provides a novel and unique prefabricated wall structure. It is further understood that additional preferred embodiments will become apparent to those skilled in the art to which it pertains, without deviating from the scope of the appended claims.

I claim:

1. A prefabricated structure for use in constructing a building wall, said structure comprising:

a first elongated joist;

second elongated joist extending in parallel and spaced apart fashion relative to said first joist;

each of said first and second joists having an opposing and parallel extending face with a recessed channel formed therein;

at least one elongate and planar shaped board, said board, belong substantially rectangular in shape and including a first edge, a second edge, a third edge, and a fourth edge, said edges defining in combination a first exterior face and a second opposite exterior face spaced from said first face by a thickness;

a first selected edge of said planar board securing in extending fashion within said recessed channel of said first joist, a further selected and parallel extending edge securing within said recessed channel of said second joist; a plurality of elongated brackets, each of said brackets further including, in cross section, a first exterior planar side, a second spaced and parallel extending exterior planar side, and an interconnecting portion extending between said first planar side and said second planar side;

a first sub-plurality of said elongated brackets extending between said first and second joists with one of said first and second planar side secured against said first exterior face of said planar shaped board;

a second sub-plurality of said elongated brackets extending between said first and second joists with one of said first and second planar sides secured against said second exterior face of said planar shaped board; and a wallboard material secured in a parallel extending and spaced relationship and against an outer-most extending surface of said brackets associated with at least one of said first and second faces of said elongate and planar shaped board.

2. The prefabricated structure as described in claim 1, said elongate brackets each further comprising a substantially "U" shape in cross section between said first and second planar sides.

3. The prefabricated structure as described in claim 2, further comprising:

selected ones of said first and second sub-pluralities of elongate brackets securing in vertically extending fashion and along their respective first planar sides to said first and second opposite faces of a first elongate and planar shaped board, said interconnecting portions of said selected brackets extending perpendicularly outwardly from said opposite faces of said first planar board level with respect to an associated vertical trailing edge of said first planar board; and additional selected ones of said first and second subpluralities of elongate brackets securing in vertically extending fashion and along their respective first planar sides to said first and second opposite faces of a second elongate and planar shaped board, said interconnecting portions of said additional selected brackets extending perpendicularly outwardly from said opposite faces of said second planar board level with respect to an associated vertical trailing edge of said second planar board and which is arrayed in opposing fashion with said abutting vertical trailing edge of said first planar board.

4. The prefabricated structure as described in claim 3, said outwardly extending and interconnecting portions of said selected brackets lying substantially flush with said outwardly extending and interconnecting portions of said additional selected brackets and being respectively secured together.

5. The prefabricated structure as described in claim 3, further comprising said wallboard material being secured by fasteners to said second spaced and parallel extending sides of at least one of said selected brackets and said additional selected brackets associated with said opposite first and second faces of said planar board.

6. The prefabricated structure as described in claim 2, further comprising a plurality of said elongate brackets extending in vertical and spaced apart fashion and being secured, at top and bottom locations of said first planar sides, to said first and second elongated joists.

7. The prefabricated structure as described in claim 6, further comprising said vertically extending and elongate brackets interengaging first and second joists of a first subset prefabricated structure in abutting and end-to-end fashion with corresponding first and second joists of a second subset prefabricated structure.

8. The prefabricated structure as described in claim 2, further comprising a plurality of said elongate brackets extending in horizontal and spaced apart fashion and being secured, along respective first planar sides, to at least one of said first and second opposite faces of said elongate and planar board.

9. The prefabricated structure as described in claim 3, further comprising a fifth elongate and substantially "U" shaped bracket in cross section, said fifth bracket including first and second parallel extending and spaced apart sides and an interconnecting portion and being of sufficient dimension to be slidingly inserted in vertically extending fashion over said interconnecting portions and second parallel extending sides of said selected vertically extending brackets and securing to said brackets, said additional selected vertically extending brackets likewise securing to said fifth bracket.

10. The prefabricated structure as described in claim 1, further comprising an insulating material being applied to at least one of said first and second faces of said elongate and planar board.

11. The prefabricated structure as described in claim 10, said insulating material further comprising a 1 and ½" thickness styrofoam sheeting.

12. The prefabricated structure as described in claim 1, further comprising third and fourth elongated joists securing in vertically extending fashion between first and second specified ends, respectively, of said first and second joists.

13. The prefabricated structure as described in claim 1, said joists further comprising, in cross section, a 2" by 4" dimension.

14. The prefabricated structure as described in claim 1, said joists further comprising, in cross section, a 2" by 6" dimension.

15. The prefabricated structure as described in claim 1, said elongate and panel board further comprising a ½" thickness OSB compressed wood chip board.

16. The prefabricated structure as described in claim 1, said joists being constructed from a wood or wood composite material.

17. The prefabricated structure as described in claim 1, said elongate brackets being constructed of a metal or metal composite material.

* * * * *